US005172084A

United States Patent [19]

Fiedziuszko et al.

[11] Patent Number: 5,172,084

[45] Date of Patent: Dec. 15, 1992

[54] MINIATURE PLANAR FILTERS BASED ON DUAL MODE RESONATORS OF CIRCULAR SYMMETRY

[75] Inventors: Slawomir J. Fiedziuszko, Palo Alto; John A. Curtis, Sunnyvale, both of Calif.

[73] Assignee: Space Systems/Loral, Inc., Palo Alto, Calif.

[21] Appl. No.: 809,868

[22] Filed: Dec. 18, 1991

[51] Int. Cl.[5] ..... H01P 1/203; H01P 7/08

[52] U.S. Cl. ..... 333/204; 333/219; 333/99 S; 505/866

[58] Field of Search ..... 333/202, 204, 205, 208-212, 333/219, 219.1, 99 S; 505/866

[56] References Cited

U.S. PATENT DOCUMENTS

| | | | |
|---|---|---|---|
| 3,796,970 | 3/1974 | Snell, Jr. | 333/134 |
| 4,453,146 | 6/1984 | Fiedziuszko | 333/212 |
| 4,489,293 | 12/1984 | Fiedziuszko | 333/212 |
| 4,540,955 | 9/1985 | Fiedziuszko | 333/212 X |

FOREIGN PATENT DOCUMENTS

| | | | |
|---|---|---|---|
| 58-99002 | 6/1983 | Japan . | |
| 0014503 | 1/1985 | Japan | 333/212 |
| 1062809A | 12/1983 | U.S.S.R. . | |

OTHER PUBLICATIONS

Zhuang et al., "Microstrip Disk Cavities Filter Using Gap Capacitance Coupling", IEEE MTT-S Digest, pp. 551-554 (1988).

Wolff, "Microstrip Bandpass Filter Using Degenerate Modes of a Microstrip Ring Resonator", Electronics Letters, vol. 8 No. 12, pp. 143-144 (1972).

Guglielmi, "Microstrip Ring-Resonator Dual-Mode Filters", distributed at the Workshop on Microwave Filters for Space Applications by ESA (European Space Agency)/ESTEC in Jun. 1991.

Fiedziuszko et al., "Miniature Dual Mode Microstrip Filters", IEEE MTT-S International Microwave Symposium Digest, vol. 2, pp. 443-446 (Jun. 1991).

*Primary Examiner*—Paul M. Dzierzynski
*Assistant Examiner*—Seung Ham
*Attorney, Agent, or Firm*—Edward J. Radlo

[57] ABSTRACT

Planar dual mode filters (30) are formed by a conductive resonator (20) having circular symmetry and two pairs of symmetrically oriented planar conductive leads (22, 26 and 24, 28). The conductive leads (22, 26 and 24, 28) are aligned colinearly with two orthogonal diameters (32, 34, respectively) of the circular conductive resonator (20) and are electrically isolated from said resonator (20). A perturbation (38) located on an axis (36) oriented symmetrically with respect to the two pairs of conductive lead (22, 26 and 24, 28) couples electromagnetic modes which are injected into the resonator (20) by the planar conductive leads (22, 26 and 24, 28). Higher order filter circuits can be realized by combining multiple filters (30) of the present invention. The filters (30) are amenable to printed circuit (microstrip to stripline) fabrication using superconductors for the conductive elements.

9 Claims, 4 Drawing Sheets

FIG.1a
PRIOR ART
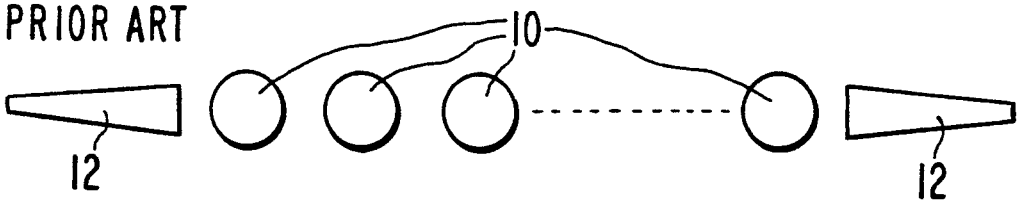
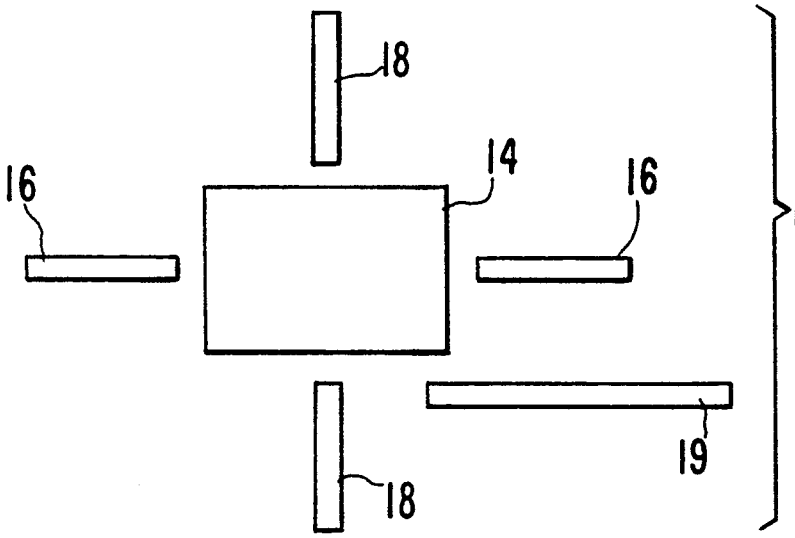
FIG.1b
PRIOR ART
FIG.2
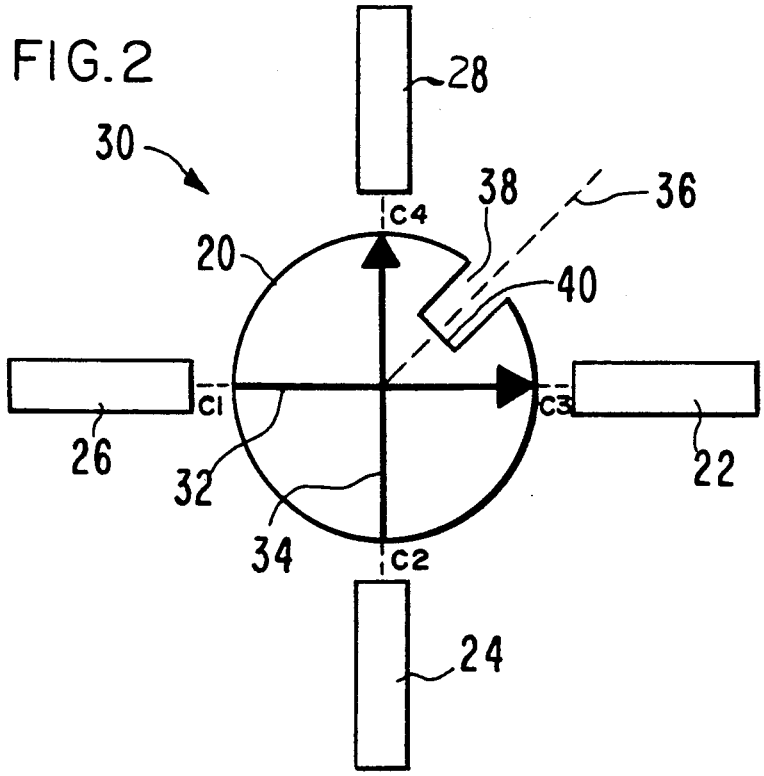

FIG.7
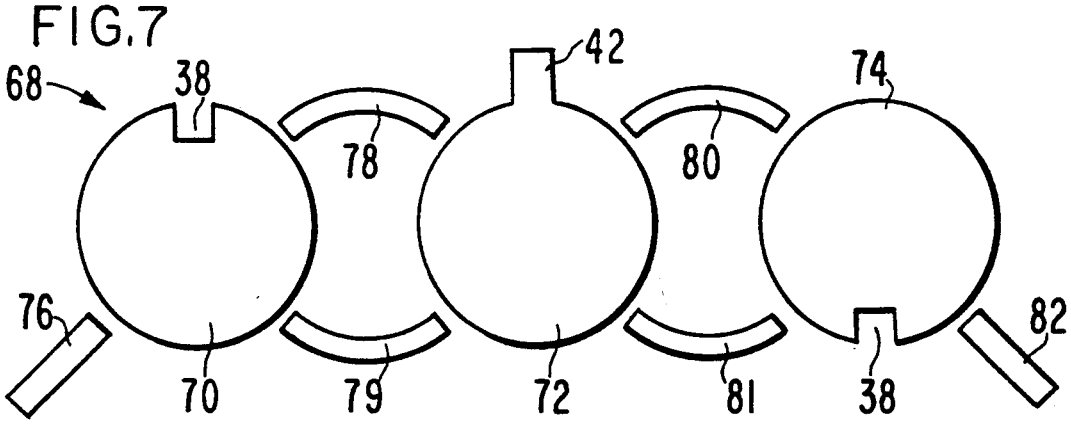
FIG.8
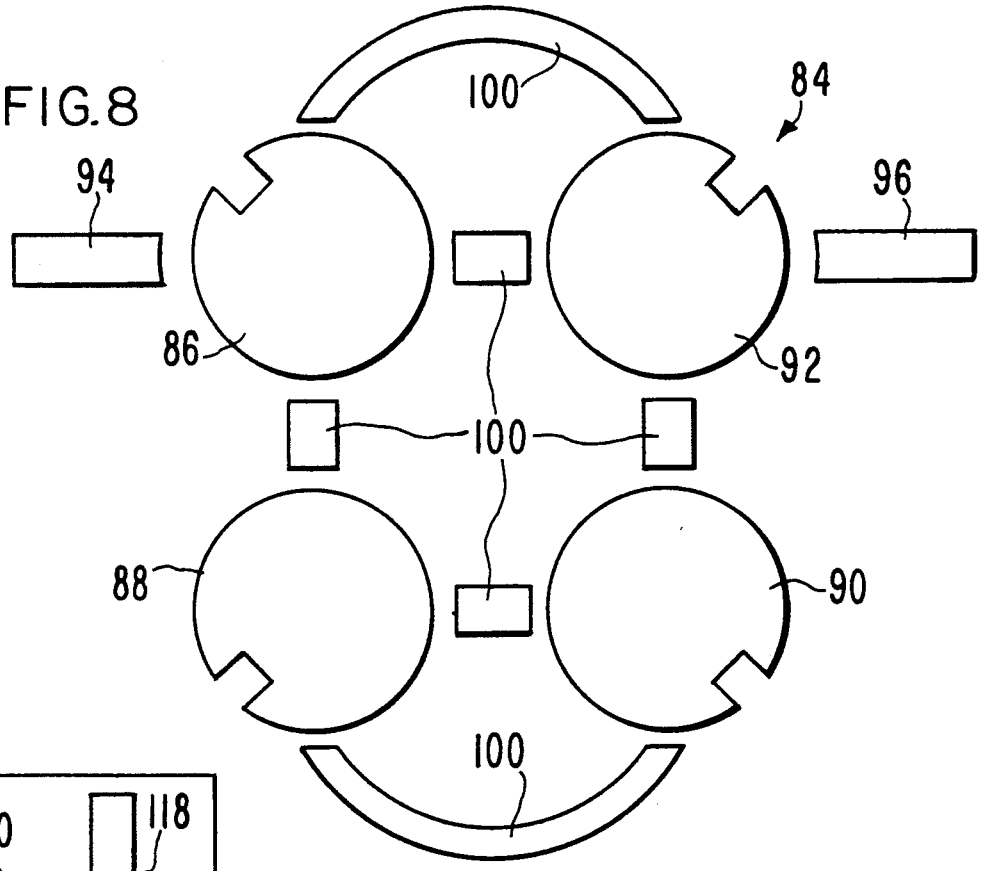
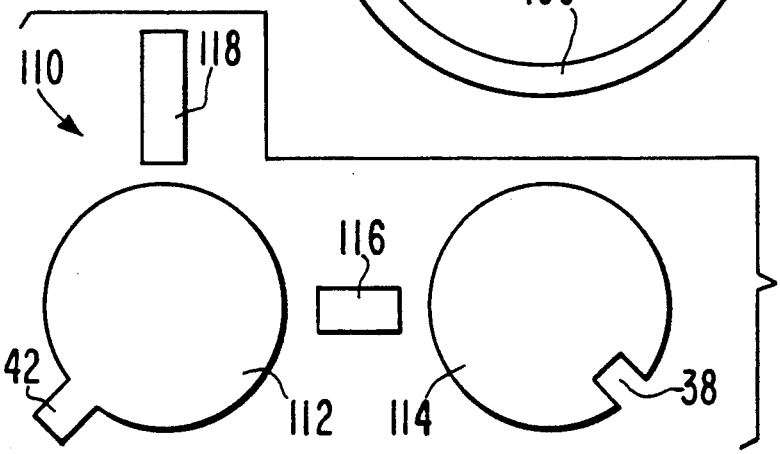
FIG.9

MINIATURE PLANAR FILTERS BASED ON DUAL MODE RESONATORS OF CIRCULAR SYMMETRY

TECHNICAL FIELD

This invention relates to high frequency electromagnetic circuits, and more particularly to microwave communication filters implemented using planar transmission line fabrication techniques.

BACKGROUND ART

Design techniques for single mode planar microwave filters, such as broadside edge coupled filters, have long been known. Implementation of such planar microwave filters is often achieved using microstrip and stripline fabrication techniques. For example, Zhuang et al., "Microstrip Disk Cavities Filter Using Gap Capacitance Coupling", *IEEE MTT-S Digest,* pp. 551–554 (1988) discloses a circular, single mode bandpass filter which is implemented in microstrip. Referring to FIG. 1*a* of the instant application, there is illustrated the single mode filter of Zhuang et al. The device comprises a linear array of circular resonant cavities 10 with a single set of conduction leads 12. Energy is coupled into and out of the resonators 10 along the axis defined by the resonators 10 and conduction leads 12.

Single mode planar filters such as those disclosed by Zhuang et al. are of limited utility for most high performance microwave applications due to their typically high insertion losses and the impracticality of designing single mode filters with passbands of less than 5%. For example, communication satellite frequency multiplexers typically require the use of dual mode cavity or dielectric resonator filters to realize self equalized, quasi-elliptic responses. These filters have passbands that are often less than 1% but have the disadvantages of large size and high cost. In addition, they are not compatible with superconductor implementation. Filters of this type are discussed in U.S. Pat. No. 4,453,146.

Planar ring resonators capable of supporting dual resonance modes are disclosed in Wolff, "Microstrip Bandpass Filter Using Degenerate Modes of a Microstrip Ring Resonator", *Electronics Letters,* Vol. 8 No. 12, pp. 143–144 (1972). However, Wolff's filter does not allow orthogonal modes to be coupled into and out of the ring resonator independently. Rather, a perturbation is used to generate the second mode from the single mode which is input to the device.

Planar rectangular filters capable of supporting dual orthogonal modes are known. Referring to FIG. 1*b* of the instant application, there is illustrated the device disclosed in U.S. Pat. No. 3,796,970. The device is based on a rectangular planar filter 14 having sides which are dimensioned to support two orthogonal resonant modes. Two pairs of conductive leads 16,18 couple energy into and out of these two orthogonal modes. However, coupling between the resonant modes is achieved only by means of an additional conductive lead 19 which is external to the resonator. Since modes are not coupled internal to the filter, quasi-elliptic and self equalized functionality are precluded.

Soviet Union patent 1,062,809A discloses a planar rectangular resonator having two sets of capacitively coupled input/output conductive leads. No means to support or control internal coupling of the resonant modes is provided.

Japanese patent 58-99002 discloses an adjustable notch in a single mode slotline ring resonator for tuning the center frequency and bandwidth of a microwave filter. Signals are coupled into and out of the resonator by means of conductor leads which are located in a plane separate from that of the resonator ring.

Guglielmi, "Microstrip Ring-Resonator Dual-Mode Filters", distributed at the Workshop on Microwave Filters for Space Applications by ESA (European Space Agency)/ESTEC in June, 1991, discloses a dual-mode filter cell having two transmission poles and two transmission zeros.

The instant inventors published portions of the instant invention in "Miniature Dual Mode Microstrip Filters", *IEEE MTT-S International Microwave Symposium Digest,* Vol. 2, pp. 443–446 (June 1991).

DISCLOSURE OF INVENTION

In accordance with the present invention, a planar dual mode resonator (20) which is operative to couple orthogonal modes internal to the resonator (20) is used in the design of high performance microwave circuits. A coupling axis (34) defined by a set of input/output conductive leads (24, 28) is added to the circular resonators of the prior art, perpendicular to the coupling axis (32) defined by the input/output conductive leads (22, 26) of the prior art. In addition, a perturbation (38) to the circular symmetry of the resonator (20) is added to the resonator (20) on an axis (36) which is oriented at an odd multiple of 45° with respect to one of the coupling axes (32, 34). This perturbation (38) facilitates coupling between the two orthogonal modes within the resonator (20).

By coupling the orthogonal modes in the manner of the present invention, each resonator (20) can be used to realize a second order transfer function (one having two frequency poles). Combining multiple resonators (20) enables the efficient realization of higher order filter circuits (30).

The present invention offers the advantages of small size, low mass, dual modes, and a planar configuration suitable for use with planar transmission lines, printed circuit fabrication, realization of elliptic function and/or self equalized response and realization using superconductors.

BRIEF DESCRIPTION OF THE DRAWINGS

FIGS. 1*a* and 1*b* are diagrams of prior art single and dual mode resonant filters;

FIG. 2 is a diagram of a circular resonator 20 in accordance with the present invention;

FIG. 7 is a drawing of a six pole filter 68 in accordance with the present invention;

FIG. 8 is a drawing of an eight pole filter 84 in accordance with the present invention; and FIG. 9 is a drawing of a four pole equalizer 110 in accordance with the present invention.

DETAILED DESCRIPTION OF THE PREFERRED EMBODIMENTS

Figure 3A:
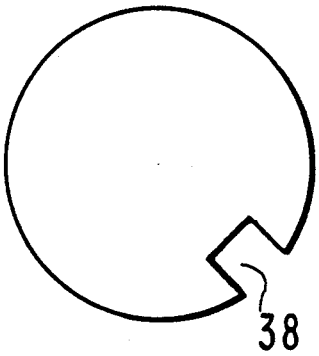
FIGS. 3*a* to 3*c* are diagrams of three different perturbations 38, 42, 44 that can be used with the present invention.

FIG. 2 is an illustration of a dual mode filter 30 having circular symmetry. A planar, circular resonator 20 has a diameter dimensioned to support resonant modes at the desired frequency. A pair of planar, conductive leads 22,26 is aligned colinearly with a diameter of the circular resonator 20, forming one coupling axis of the filter 30. A vector 32, which is colinear with this coupling axis and within resonator 20, indicates the direction of propagation for a resonant mode which is coupled into resonator 20 through conductive lead 26.

A second coupling axis perpendicular to the first is defined by the planar conductive leads 24,28, which are aligned colinearly with a second diameter of resonator 20. A second vector 34 indicates the direction of propagation of a mode coupled into resonator 20 by conductive lead 24.

A rectangular cut away section 38 is made in circular resonator 20 along an axis 36 which is oriented symmetrically with respect to vectors 32,34. The cut away section 38 has an edge 40 which is perpendicular to and bisected by axis 36. The cut away section 38 perturbs the symmetry of circular resonator 20, inducing coupling between the resonant modes introduced along vectors 32,34. Although the perturbation 38 is shown oriented symmetrically with respect to vectors 32,24, coupling between the orthogonal modes can be accomplished by a perturbation which is located at an odd multiple of 45° from either vector 32,34.

Figure 3B:
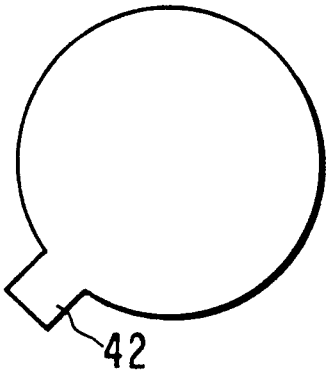
Figure 3C:
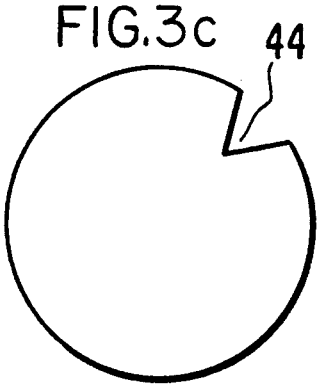

Any size or shape perturbation will be operative to couple the modes characterized by vectors 32,34. Referring to FIGS. 3*a–c*, there are illustrated three of the many possible perturbations which may be utilized in the present invention. These are a cut out 38, a stub 42, and a notch 44. The strength of the coupling between the orthogonal modes characterized by the vectors 32,34 can be controlled by varying the size and shape of the perturbations 38,42,44.

As drawn, resonator 20 with planar conductive leads 22–28 and cut out 38 is electrically symmetrical and reciprocal. For the remainder of the discussion, it is assumed that energy is coupled into resonator 20 from planar conductive leads 24,26 through capacitive coupling gaps C1,C2. Similarly, energy is coupled out of resonator 20 to planar conductive leads 22,28 through capacitive coupling gaps C3,C4. (Alternatively, leads 22 and 28 could comprise the input, with leads 24 and 26 as the output.)

Figure 4:
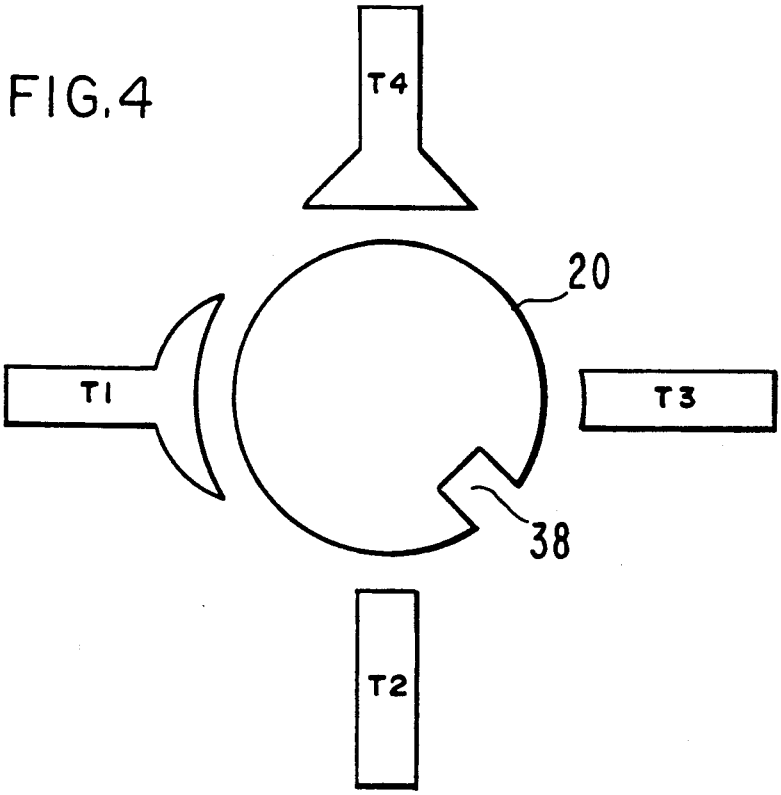
FIG. 4 is a diagram illustrating transmission line structures T1–T4 that may be used to couple energy into and out of a resonator 20.

In the absence of the cut away perturbation 38, energy coupled into resonator 20 by conductive lead 24, which is characterized by vector 34, would resonate parallel to vector 34 and be coupled out of resonator 20 through capacitive gap C4 to conductive lead 28. Addition of rectangular perturbation 38 causes some energy from this mode to be coupled into the mode characterized by vector 32. The amount of coupling between the modes characterized by vectors 32,34 can be controlled by the size and shape of the perturbation 38. The capacitive coupling coefficients between conductive leads 22–28 and circular resonator 20 can be adjusted by varying the size and shape of capacitive coupling gaps C1–C4. Some of the possible variations T1–T4 in the structure of conductive leads 22–28 are illustrated by FIG. 4. The filter 30 can be implemented in microstrip or stripline. In either case, the conductive elements 20, 22, 24, 26, 28 are preferably fabricated of a superconductor.

Figure 5:
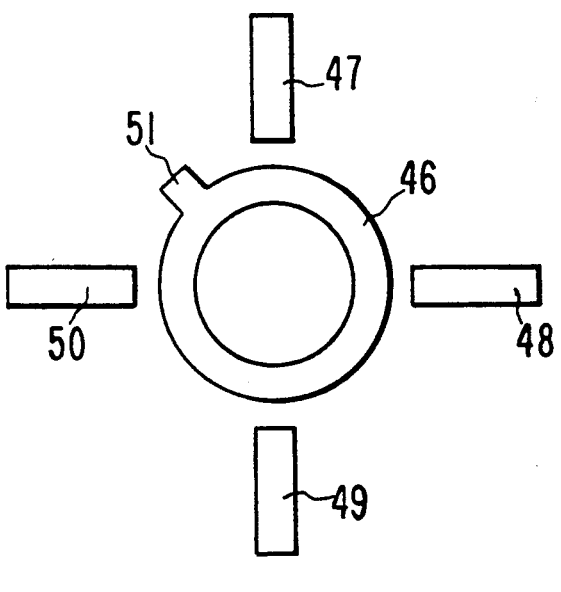
FIG. 5 is a diagram of a ring resonator 46 in accordance with the present invention.

Referring now to FIG. 5, there is illustrated a ring resonator 46 which may be used to generate the dual mode resonator behavior described in conjunction with the circular filter 30 of FIG. 2. Ring resonator 46 is dimensioned to support the desired resonant mode and has a pair of perpendicular coupling axes defined by the input/output conductive leads 47 and 49, and 48 and 50, respectively. A perturbation 51 couples energy from the resonant modes which are introduced into resonator 46 through the conductive leads 47,49.

Figure 6A:
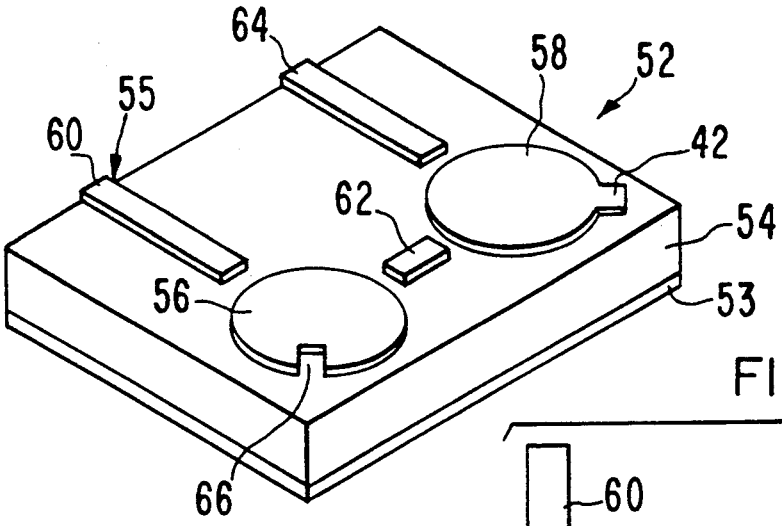
FIG. 6*a* is a diagram of a four pole filter 52 in accordance with the present invention.

Referring now to FIG. 6*a*, there is illustrated a relief view of a four pole filter 52 based on microstrip technology and utilizing circular filter 30 of the present invention. Filter 52 is constructed by depositing conducting layers 53,55 on opposing faces of a dielectric slab 54. Circular filters 56,58 and planar conductive leads 60, 62, 64 in accordance with the present invention are generated on the top of dielectric 54 by etching conductive layer 55. The unetched conductive layer 53 on the bottom of dielectric 54 serves as a ground plane.

In the four pole filter of FIG. 6*a*, conductive lead 60 provides energy from an electromagnetic input signal to resonator 56, where a rectangular cut out 66 couples some of this energy into an orthogonal mode. Energy is coupled out of resonator 56 and into resonator 58 by means of a conductive lead 62. Additional second order filtering is introduced in resonator 58. The output signal of this four pole filter is sampled along conductive lead 64.

Figure 6B:
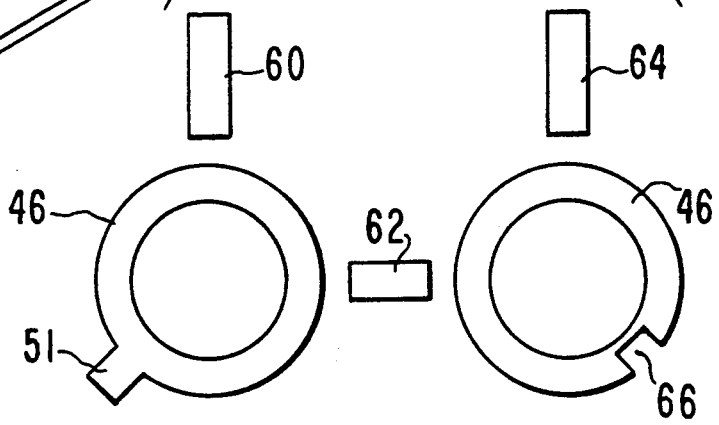
FIG. 6*b* is a diagram of a four pole filter of the present invention which utilizes ring resonators 46.

FIG. 6*b* is a schematic drawing of an analogous four pole filter constructed using the ring resonators 46 of FIG. 5 in place of the circular resonators 56,58 of FIG. 6*a*.

Referring now to FIG. 7, a six pole filter 68, using three dual mode resonators 70, 72, 74 in accordance with the present invention, is illustrated. Energy is input into resonator 70 along an input conductive lead 76, where some of it is coupled into an orthogonal mode. Energy from both modes is then transferred sequentially to resonators 72 and 74 through the transmission leads 78 and 79, and 80 and 81, respectively, where additional second order filtering occurs. The output is sampled along transmission lead 82. In each filter 70, 72, 74, coupling between orthogonal modes is implemented by one of the perturbations 38,42,38, respectively.

Referring now to FIG. 8, an eight pole filter 84 in accordance with the present invention is illustrated. The filter 84 comprises four circular resonators 86, 88, 90, 92, which are capacitively coupled to conductive leads 100 and input/output transmission leads 94,96, respectively.

Referring now to FIG. 9, a four pole equalizer 110 in accordance with the present invention is illustrated. Equalizer 110 comprises circular filters 112,114 which communicate via conductive lead 116. An input/output conductive lead 118 couples energy into and out of equalizer 110. Equalizers having six and eight poles can be constructed in a manner similar to that used to construct six and eight pole filters.

The invention has now been explained with reference to specific embodiments. Other embodiments will be apparent to those of ordinary skill in the art in light of this disclosure. Therefore, it is not intended that this invention be limited, except as indicated by the appended claims.

I claim:

1. A dual mode planar filter for filtering electromagnetic signals, said filter comprising:

a substantially planar, substantially circular conductive element dimensioned to support resonant electromagnetic modes at the frequency of said signals;

first and second coupling axes oriented perpendicular to each other, each of said first and second coupling axes comprising a pair of planar conductive leads oriented colinearly with a diameter of said substantially circular conductive element and electrically isolated from said element, for coupling electromagnetic energy into and out of said element; and a perturbation means located at the periphery of said circular conductive element and having a symmetric orientation about an axis which is an odd multiple of 45° from each of said first and second coupling axes, for coupling together orthogonal resonant modes of electromagnetic energy injected into said substantially circular conductive element along said first and second coupling axes.

2. The dual mode planar filter of claim 1, wherein the filter is implemented using microstrip.

3. The dual mode planar filter of claim 2, wherein conductive items within the microstrip are fabricated of a superconductor.

4. The dual mode planar filter of claim 1, wherein the filter is implemented using stripline.

5. The dual mode planar filter of claim 4, wherein conductive elements within the stripline are fabricated of a superconductor.

6. The dual mode planar filter of claim 1, wherein the perturbation means is located on an axis which is symmetrically located with respect to the conductive leads of said first and second coupling axes.

7. A dual mode planar filter for filtering electromagnetic signals, said filter comprising:

a substantially planar, substantially annular conductive element dimensioned to support resonant electromagnetic modes at the frequency of said signals;

first and second coupling axes oriented perpendicular to each other, each of said first and second coupling axes comprising a pair of planar conductive leads oriented colinearly with a diameter of said substantially circular conductive element and electrically isolated from said element, for coupling electromagnetic energy into and out of said element; and a perturbation means located at the periphery of said element and having a symmetric orientation about an axis which is an odd multiple of 45° from each of said first and second coupling axes, for coupling together electromagnetic modes injected into said element along said first and second coupling axes.

8. A dual mode planar filter for filtering electromagnetic signals, aid filter comprising:

at least two substantially planar, substantially circular conductive elements electromagnetically coupled to each other, each element dimensioned to support resonant electromagnetic modes at the frequency of said signals;

associated with each element, first and second coupling axes oriented perpendicular to each other, each of said first and second coupling axes comprising a pair of planar conductive leads oriented colinearly with a diameter of said element and electrically isolated from said element, for coupling electromagnetic energy into and out of said element in the plane of said conductive elements; and a perturbation means located at the periphery of each said element and having a symmetric orientation about an axis which is an odd multiple of 45° from each of the first and second coupling axes associated with said element, for coupling together orthogonal resonant modes of electromagnetic energy injected into said element along said first and second coupling axes.

9. A dual mode planar filter for filtering electromagnetic signals, said filter comprising:

at least two substantially planar, substantially annular conductive elements electromagnetically coupled to each other, each element dimensioned to support resonant electromagnetic modes at the frequency of said signals;

associated with each element, first and second coupling axes oriented perpendicular to each other, each of said first and second coupling axes comprising a pair of planar conductive leads oriented colinearly with a diameter of said element and electrically isolated from said element, for coupling electromagnetic energy into and out of said element in the plane of said conductive elements; and a perturbation means located at the periphery of each said element and having a symmetric orientation about an axis which is an odd multiple of 45° from each of the first and second coupling axes associated with said element, for coupling together electromagnetic modes injected into said element along said first and second coupling axes.

* * * * *